US012571208B2

(12) United States Patent
Safford

(10) Patent No.: US 12,571,208 B2
(45) Date of Patent: Mar. 10, 2026

(54) SYSTEM AND METHOD FOR SECTIONAL CONSTRUCTION ASSEMBLY

(71) Applicant: Innovation Glass, LLC, Tivoli, NY (US)

(72) Inventor: Franz Safford, Tivoli, NY (US)

(73) Assignee: Innovation Glass, LLC, Tivoli, NY (US)

( * ) Notice: Subject to any disclaimer, the term of this patent is extended or adjusted under 35 U.S.C. 154(b) by 267 days.

(21) Appl. No.: 18/582,962

(22) Filed: Feb. 21, 2024

(65) Prior Publication Data

US 2025/0263924 A1 Aug. 21, 2025

(51) Int. Cl.
*E04B 2/74* (2006.01)

(52) U.S. Cl.
CPC ..... *E04B 2/7435* (2013.01)

(58) Field of Classification Search
CPC .... E04B 2/7433; E04B 2/7435; E04B 2/7437; E04B 2/7438; E04B 2002/7446
See application file for complete search history.

(56) References Cited

U.S. PATENT DOCUMENTS

| | | | |
|---|---|---|---|
| 2,345,650 | A | 4/1944 | Attwood |
| 2,901,785 | A | 9/1959 | Hinchliffe et al. |
| 2,996,845 | A | 8/1961 | Cipriani et al. |
| 3,052,330 | A | 9/1962 | Hammit et al. |
| 3,053,353 | A | 9/1962 | Miller |
| 3,176,806 | A | 4/1965 | Ferrell |
| 3,266,209 | A | 8/1966 | Jules |
| 3,266,210 | A | 8/1966 | Grossman |
| 3,321,880 | A | 5/1967 | Ferrell et al. |
| 3,478,480 | A | 11/1969 | Swensen |
| 3,548,558 | A | 12/1970 | Grossman |
| 3,561,182 | A | 2/1971 | Madl, Jr. |
| 3,813,120 | A | 5/1974 | Kelly |

(Continued)

FOREIGN PATENT DOCUMENTS

| | | |
|---|---|---|
| CN | 216865635 | 7/2022 |
| DE | 10111246 | 9/2002 |

(Continued)

OTHER PUBLICATIONS

Search Report and Written Opinion for PCT/US2025/016416 (11 pages). (Year: 2025).*

(Continued)

*Primary Examiner* — Rodney Mintz
(74) *Attorney, Agent, or Firm* — Noblitt & Newson, PLLC

(57) ABSTRACT

A fitting for a construction system for a glass panel having a mullion with at least one guide track disposed at least partially along at least one dimension of the mullion, a curved exterior face, and a guide channel extending along a length of the curved exterior face. The fitting may comprise an inner fitting, an outer fitting and a fastener couple the inner fitting to the outer fitting. The inner fitting may be configured to be slidably coupled to the curved exterior face of the mullion. The inner fitting may comprise an angular variation device, a panel support surface, and an arm extending between the angular variation device and the panel support surface. The fitting is selectively adjustable along the guide track while engaged to the guide track and a portion of the glass panel is received between the inner fitting and the outer fitting.

18 Claims, 18 Drawing Sheets

(56) References Cited

U.S. PATENT DOCUMENTS

| | | | | |
|---|---|---|---|---|
| 3,900,996 | A | 8/1975 | Yohe | |
| 3,938,297 | A | 2/1976 | Sato et al. | |
| 4,031,680 | A | 6/1977 | Stoakes | |
| 4,073,113 | A | 2/1978 | Oudot et al. | |
| 4,469,198 | A | 9/1984 | Crump | |
| 4,500,572 | A | 2/1985 | Francis | |
| 4,560,130 | A | 12/1985 | Schwartz | |
| 4,568,050 | A | 2/1986 | Radoy et al. | |
| 4,680,905 | A | 7/1987 | Rockar | |
| 4,784,552 | A | 11/1988 | Rebentisch | |
| 4,873,805 | A | 10/1989 | Ting | |
| 4,873,806 | A | 10/1989 | Jeschke | |
| 4,895,331 | A | 1/1990 | Nehls | |
| 4,948,313 | A | 8/1990 | Zankovich | |
| 5,154,385 | A | 10/1992 | Lindberg et al. | |
| 5,209,619 | A | 5/1993 | Rinderer | |
| 5,245,808 | A | 9/1993 | Grunewald et al. | |
| 5,481,839 | A | 1/1996 | Lang et al. | |
| 5,833,417 | A | 11/1998 | Sargent et al. | |
| 5,839,236 | A | 11/1998 | Frey | |
| RE36,681 | E | 5/2000 | Rinderer | |
| 6,086,300 | A | 7/2000 | Frohlich | |
| 6,105,794 | A | 8/2000 | Bauer | |
| 6,401,410 | B2 | 6/2002 | Kenny et al. | |
| 6,484,465 | B2 | 11/2002 | Higgins | |
| 6,588,711 | B2 | 7/2003 | Onishi | |
| 6,598,361 | B2 | 7/2003 | Ting | |
| 6,712,540 | B2 | 3/2004 | Schmalzhofer et al. | |
| 6,827,320 | B2 | 12/2004 | Yeh | |
| 7,004,667 | B2 | 2/2006 | Ludwig et al. | |
| 7,234,566 | B2 | 6/2007 | Simmons | |
| 7,478,504 | B2 | 1/2009 | Huebner et al. | |
| 7,716,891 | B2 | 5/2010 | Radford | |
| 7,818,931 | B2 * | 10/2010 | Grunewald | E04B 2/96 52/844 |
| 8,973,316 | B2 * | 3/2015 | Safford | E04B 2/96 52/235 |
| 9,567,746 | B1 | 2/2017 | Barbulescu et al. | |
| 9,909,309 | B1 | 3/2018 | Conklin | |
| 11,952,770 | B2 * | 4/2024 | Taylor | E04B 1/388 |
| 11,982,122 | B2 * | 5/2024 | Condon | E04B 2/96 |
| 2001/0004099 | A1 * | 6/2001 | Onishi | F16B 37/045 248/65 |
| 2001/0011444 | A1 * | 8/2001 | Kenny | E06B 3/5427 52/235 |
| 2002/0124514 | A1 | 9/2002 | Higgins | |
| 2003/0033764 | A1 * | 2/2003 | Ting | E04C 3/32 52/235 |
| 2003/0036314 | A1 * | 2/2003 | Schmalzhofer | F16B 7/187 439/680 |
| 2004/0025459 | A1 | 2/2004 | Huebner et al. | |
| 2004/0033103 | A1 * | 2/2004 | Ludwig | F16B 7/187 403/188 |
| 2004/0155161 | A1 * | 8/2004 | Yeh | A47B 57/565 248/220.22 |
| 2004/0221526 | A1 | 11/2004 | Rinehart et al. | |
| 2005/0098392 | A1 * | 5/2005 | Simmons | B66B 7/027 187/414 |
| 2005/0284053 | A1 | 12/2005 | Grunewald et al. | |
| 2006/0123722 | A1 | 6/2006 | Stenvall et al. | |
| 2007/0094955 | A1 | 5/2007 | Safford | |
| 2007/0194191 | A1 | 8/2007 | Persson | |
| 2009/0145071 | A1 * | 6/2009 | Radford | E04F 19/061 52/506.08 |
| 2016/0222653 | A1 | 8/2016 | Niehaus et al. | |
| 2023/0038884 | A1 | 2/2023 | Condon et al. | |
| 2023/0243148 | A1 | 8/2023 | Taylor et al. | |
| 2025/0263925 | A1 * | 8/2025 | Safford | E04B 2/7435 |
| 2025/0277365 | A1 * | 9/2025 | Safford | E04B 2/90 |
| 2025/0297508 | A1 * | 9/2025 | Safford | B21C 23/142 |

FOREIGN PATENT DOCUMENTS

| | | | |
|---|---|---|---|
| EP | 0136431 | A2 | 4/1985 |
| FR | 2585391 | A1 | 1/1987 |
| GB | 2397310 | A | 7/2004 |
| KR | 20110100608 | A | 9/2011 |
| WO | 95/13439 | A1 | 5/1995 |
| WO | 00/45020 | A1 | 8/2000 |
| WO | 2002101166 | A1 | 12/2002 |
| WO | 2004083545 | A1 | 9/2004 |
| WO | 2010063297 | A1 | 6/2010 |

OTHER PUBLICATIONS

Stabalux Brochure, Apr. 1, 2008.
QuadroClad Facades, 2008.
Halfen Channel, Halfen GmBH, Jun. 2022.

* cited by examiner

SYSTEM AND METHOD FOR SECTIONAL CONSTRUCTION ASSEMBLY

BACKGROUND OF THE TECHNOLOGY

A variety of systems are used in the construction of buildings. Many of these systems employ a framework, such as in the case of conventional point-supported and conventional glass wall systems. In these systems, panes of glass are attached to, and supported by horizontal and vertical mullions. The shapes and configurations of the buildings are sometimes constrained since the vertical mullions need to be oriented perpendicular to the outside surfaces of the glass panels.

SUMMARY OF THE TECHNOLOGY

A system and method for the assembly and support of construction sections. The system may generally include a guide track disposed within a mullion and a fitting that is suitably adapted for supporting a construction section or glass panel. The fitting may be configured to hold and retain a construction section or glass panel once the fitting is engaged within the guide track of the mullion. The mullion may include an angular face that cooperates with a radial fitting to allow the glass panel to be oriented in a configuration that is not perpendicular with the axis of the mullion.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures. For simplicity and clarity of illustration, elements in the figures are not necessarily drawn to scale.

DETAILED DESCRIPTION OF THE DRAWINGS

The present technology may be described in terms of functional block components and various processing steps. Such functional blocks may be realized by any number of components configured to perform the specified functions and achieve the various results. For example, the present technology may employ various types of mullions, guide tracks, fittings, hangers, fasteners, spacers, glass panels, walls, and the like, which may carry out a variety of functions. Further, the present technology may employ any number of components for a point supported construction system for supporting a glass panel.

Various representative implementations of the present technology may be applied to any system for construction. Certain representative implementations may include systems and methods tailored to a specific type of construction, such as point-supported glass wall systems.

In general point-supported glass wall systems utilize fittings connected with mullions to provide support for various types of construction sections. The fitting may be attached to a mullion and the construction section or glass panel is supported by the fitting. The mullions are generally oriented perpendicular to the exterior surface of the building/wall/glass panel which they support. As such, a standard mullion generally has a flat, planar surface that is generally perpendicular to the longitudinal centerline of the mullion and parallel to the exterior surface of the building/wall/glass panel that it supports. The fitting is attached to the flat, planar surface of the mullion and the exterior surface of the building/wall/glass panel supported by the fitting is oriented generally perpendicular to the longitudinal centerline of the mullion.

Figure 1:
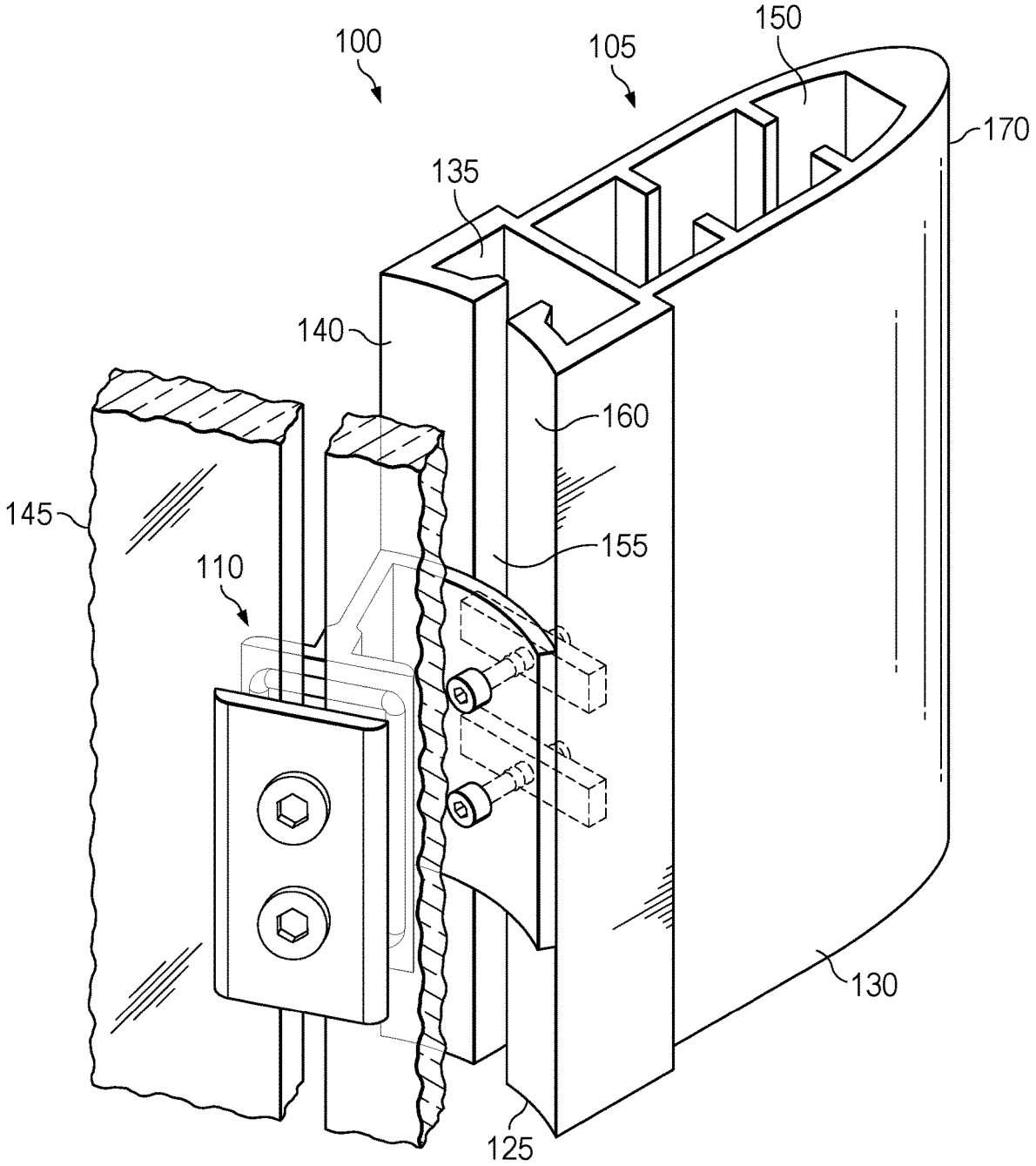
FIG. 1 representatively illustrates an isometric assembled view of a construction assembly with a fitting attached to a mullion and supporting a glass panel in accordance with an exemplary embodiment of the present technology.
Figure 2:
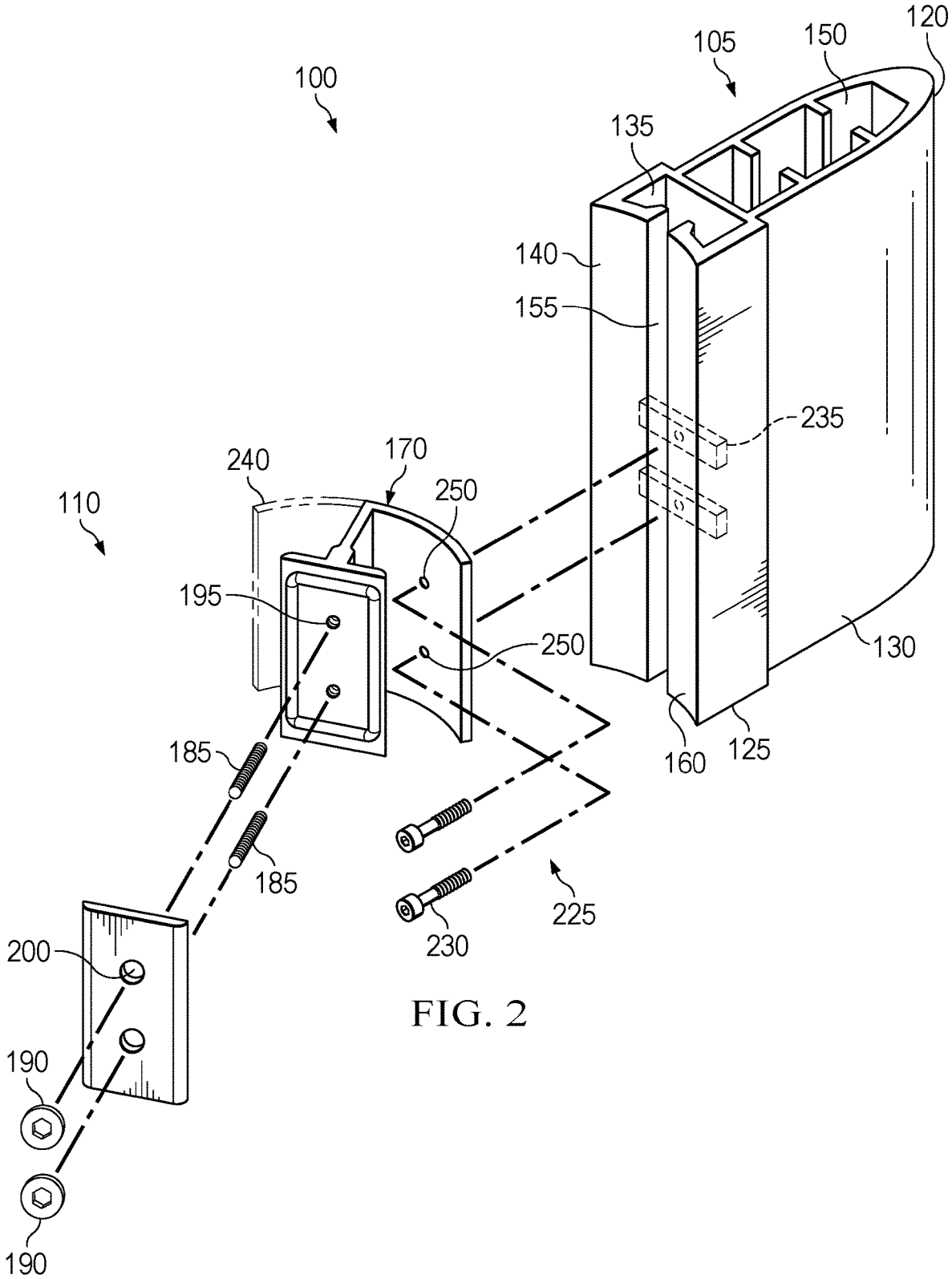
FIG. 2 representatively illustrates an isometric, exploded view of a construction assembly with a fitting and a mullion accordance with an exemplary embodiment of the present technology.
Figure 3:
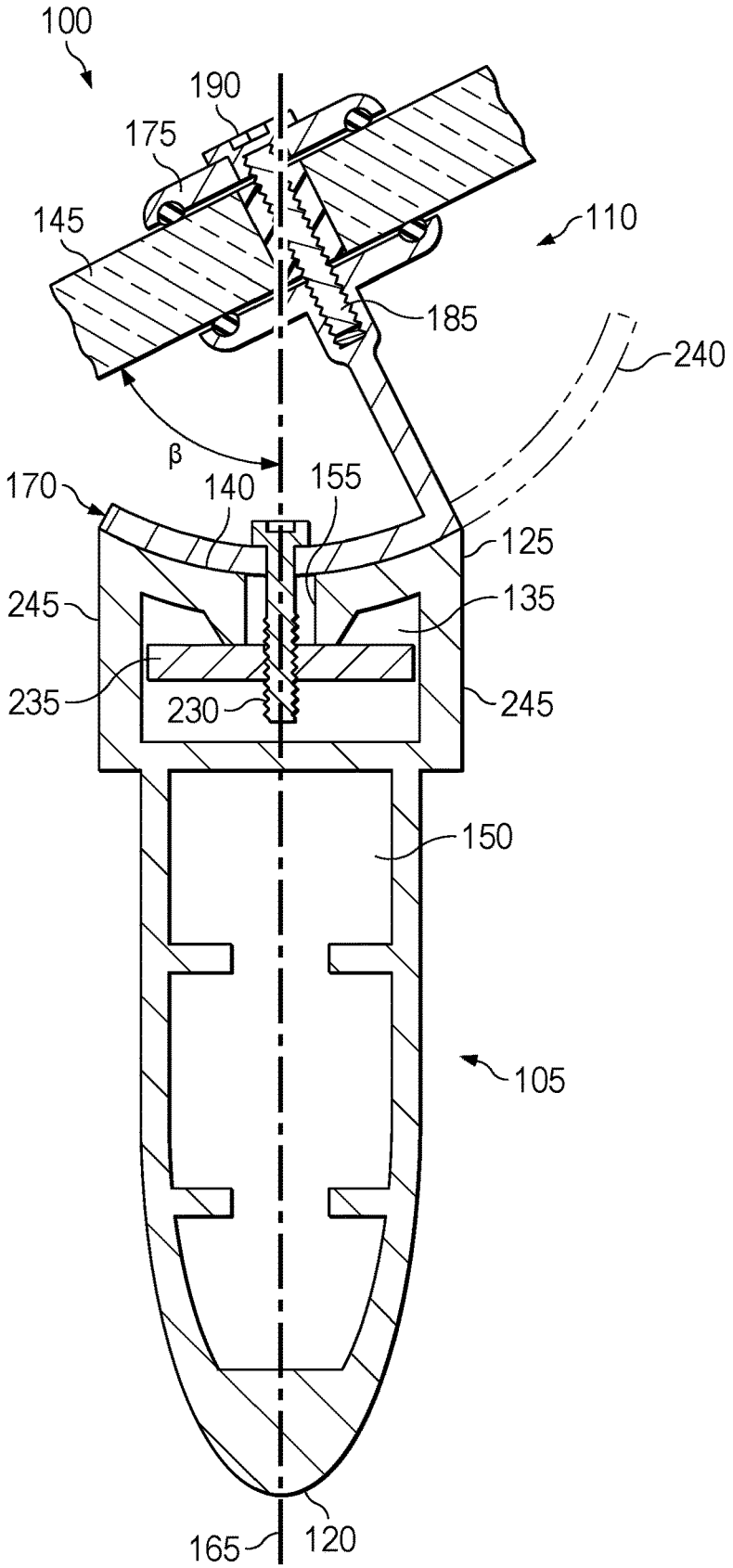
FIG. 3 representatively illustrates a top, cross-sectional view of a construction assembly with a fitting attached to a mullion and supporting a glass panel in accordance with an exemplary embodiment of the present technology.

Referring now to FIGS. 1-3, a construction system 100 generally comprises a mullion 105 and a fitting 110. The mullion 105 is generally configured for engagement with the fitting 110 and provides support for a construction section and/or glass panel held in place by the fitting 110. The mullion 105 may comprise any structural or design features that may be employed to allow for the attachment of the fitting(s) 110 for providing support and/or retention of construction sections. The construction sections may comprise wood, ceramic, glass, glass panels, polymer sheeting, bullet-proof glass, synthetic paneling, and the like.

The mullion 105 may be fabricated using any method of manufacture known in the art and may include any number of suitable materials, such as aluminum, steel, graphite, composite and/or the like. In one embodiment, the mullion 105 may be fabricated from forged or extruded aluminum.

The mullion 105 may comprise a first end 120 that may be positioned towards the interior of a structure being constructed and a second end 125 configured to be coupled to the fitting 110. A mullion body 130 is located between the first end 120 and the second end 125 of the mullion 105.

The second end 125 of mullion 105 may comprise a guide track 135 and an exterior face 140. The guide track 135 may be disposed along at least one dimension of the mullion 105. The guide track 135 may be disposed along a substantially linear length of the mullion 105 and may be suitably adapted for adjustable engagement with the fitting 110. The fitting 110 may be adjusted along the guide track 135 and substantially fixed in place at any point along the guide track 135. The fitting 110 may be suitably configured to support any type of construction section, such as a pane of glass or glass panel 145.

The guide track 135 may be positioned, for example, towards the exterior of a structure being constructed using the disclosed systems and methods, and may provide suitable anchor points for attachment of the fitting 110 that retains and supports a construction section/glass panel 145. The structure of the mullion 105 allows it to support the weight of the construction section or glass panel 145 held by the fitting 110. Additionally, the mullion 105 may permit translational or rotational motion in response to environmental effects, such as wind, rain and/or thermal expansion or contraction.

The mullion 105 generally comprises a structure having one or more void cavities 150 and a guide channel 155. The cavity 150 may be of any volume or shape and may be disposed within any part of the mullion 105. For example, the mullion 105 may comprise a plurality of cavities with intervening structures between the void cavities 150, for example, in order to increase the load bearing strength of the mullion 105.

The mullion 105 may connect with any suitable structures, systems and devices in any suitable manner to achieve any particular purpose. The mullion 105, be configured for attachment to a surface such as a floor, wall and/or the like. The mullion 105 may be attached to any suitable surface in any suitable manner, and may be configured to support any structure, system, device or architectural element in any suitable manner. For example, the structure of the mullion 105 may comprise the guide track 135 that operates with the fitting 110 to provide attachment and support for glass panels 145.

In general, the guide track 135 and guide channel 155 generally enable the fittings 130 to be connected to the mullion 105. The guide track 135 may be fabricated from any material, whether now known or otherwise hereafter described in the art. The guide track 135 may comprise any shape, size or configuration and may include any number of sub-systems and/or design features to achieve any particular purpose.

The exterior face 140 of the mullion 105 may comprise a curved surface 160 configured to mate with the fitting 110. The curved surface 160 may comprise an outer surface that is convex with respect to the exterior surface of the construction section or glass panel 145 to which the curved surface 160 faces. The guide channel 155 may extend the length or a portion of the curved surface 160 of exterior face 140 of the mullion 105. As shown in FIG. 3, the guide channel 155 may be aligned with the centerline 165 of the mullion 105.

Figure 4:
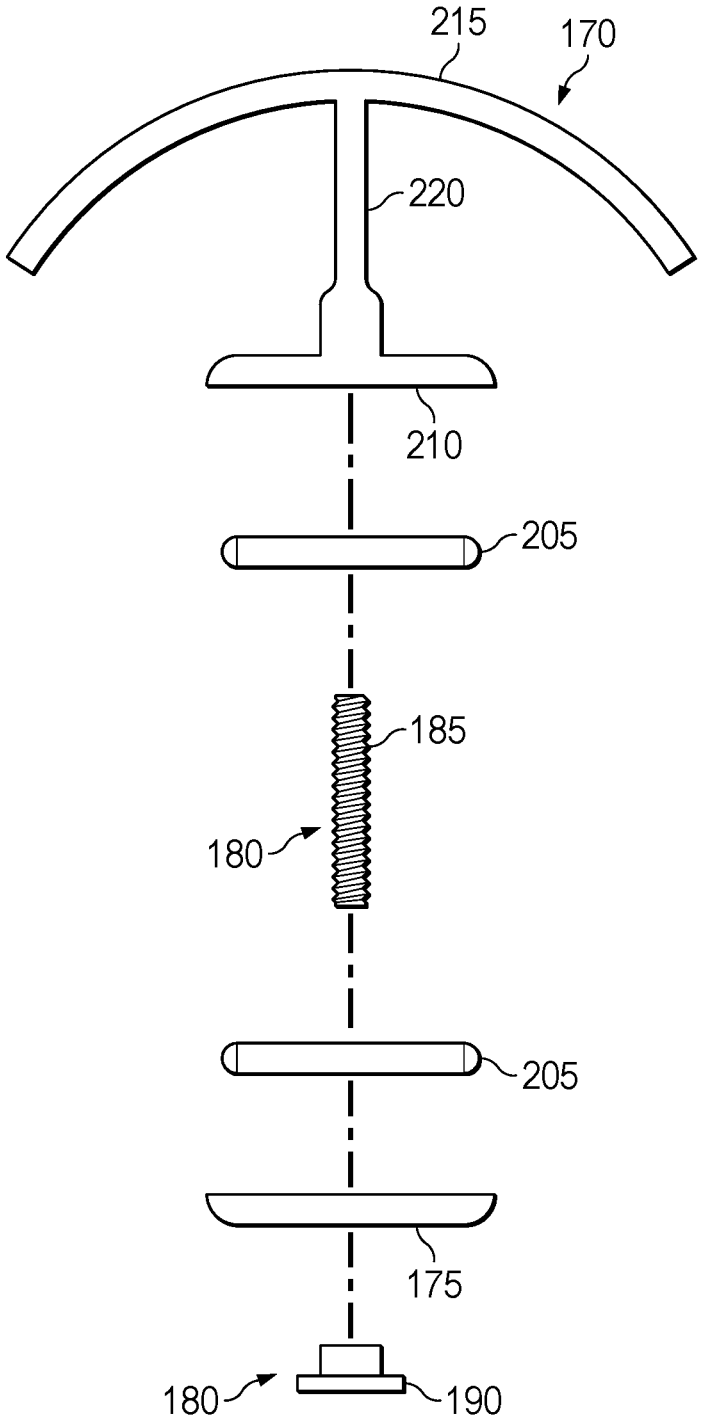
FIG. 4 representatively illustrates an exploded plan view of a fitting in accordance with an exemplary embodiment of the present technology.

Referring now to FIG. 4, the fitting 110 may include an inner fitting 170 and an outer fitting 175 that are coupled together with a fastener 180. The inner fitting 170 and outer fitting 175 are configured to support the construction section and/or glass panel 145. In various embodiments, the fastener may comprise a stud 185 and cap nut 190. In one embodiment, the fastener may comprise a pair of studs 185 and a pair of cap nuts 190. When installed, the stud(s) 185 may be received in a recess(es) 195 within the inner fitting 170 and project through an aperture(s) 200 in the outer fitting 175. The cap nut(s) 190 may then be coupled to the stud(s) 185 to assemble the fitting 110, which can then support the glass panel 145. The stud(s) 185, cap nut(s) 190, and recess(es) 195 may be threaded as understood by one of ordinary skill in the art.

The fitting 110 may comprise a pair of gaskets 205 configured to support the attachment of the glass panel 145 to the fitting 110. The gaskets 205 may be located between the inner fitting 170 and the glass panel 145 and outer fitting 175 and the glass panel 145. Upon installation the gaskets 205 serve to support the glass panel between the inner and outer fittings 170, 175. Installation occurs when a portion of the glass panel 145 is placed between the inner fitting 170 and outer fitting 175. The gaskets 205 are located between the inner fitting 170 and the glass panel 145 and outer fitting 175 and the glass panel 145. Typically, a portion of the glass panel 145 is installed on the fitting 110 and the fitting 110 is then attached to the mullion 105.

The inner fitting 170 may comprise an angular variation device for altering the angle of the glass panel 145 with respect to the orientation of the mullion 105. Standard fittings and mullions typically only allow the construction sections that are supported by the fitting to be oriented at a right angle or perpendicular to the mullion. The angular variation device allows the angle of the fitting (construction sections/glass panels) with respect to the mullion to be oriented at any angles selected during installation.

The inner fitting 170 may comprise a panel support surface 210, a radial surface 215, and an arm 220 located therebetween. The panel support surface 210 along with the gasket 205 engages with the glass panel 145 and/or construction section. The arm 220 comprises a first end that extends from the panel support surface 210 at a right angle and is oriented generally perpendicular to the panel support surface 210. The arm 220 extends between the panel support surface 210 and the radial surface 215. The arm 220 is oriented generally perpendicular to the radial surface 215, which connects to the mullion 105.

Referring to FIG. 3, the radial surface 215 of the inner fitting 170 may be attached to the curved surface 160 of the exterior face 140 of the mullion 105 by fasteners 225. The fasteners 225 may comprise at least one bolt 230 and nut 235 configuration. Once the fitting 110 is attached to the mullion 105, the fitting 110 may still be moved with respect to the mullion 105. The bolts 230 are received within the guide track 155 and the nuts 235 are coupled thereto within the guide channel. 135. The fitting 110 is still movable with respect to the mullion 105 until the fasteners 225 are secured.

The orientation of the radial surface 215 and the curved surface 160 allow the fitting 110 to engage with the mullion 105 and rotate along an angle β to accommodate various wall plane angles, which is the angle β between the mullion centerline 165 and the plane of the glass panel 145.

The radial surface 215 extends outwardly from the arm 220 to create an arc shape. The arc shape of the radial surface 215, when installed, abuts and runs parallel to the curved surface 160 of the exterior face 140. The arc shape of the radial surface 215 is convex with respect to the exterior surface of the construction section or glass panel 145 to which the curved surface 160 faces.

Referring to FIGS. 2 and 3, once designed, excess material 240 beyond the edge 245 of the mullion 105 is trimmed away or removed. The excess material 240 may be removed during production in a factory. For installation of the fitting 110 to the mullion 105, the inner fitting 170 is positioned on the exterior face 140 of the mullion 105 at desired angle beta, β. At least one hole 250 is drilled in the radial surface 215 of the inner fitting 170 such that the central lines of the at least one hole 250 aligns with the center line 165 of the guide channel 135. The inner fitting 110 is then attached to the guide track 135 of the mullion and held in-place by fasteners 225 comprising the at least one bolt 230 and nut 235 configuration. The bolts 230 are received within the guide track 155 and the nuts 235 are coupled thereto within the guide channel 135. In one embodiment, the inner fitting is held in place at the correct position along curved surface 160, the bolt 230 and nut 235 configuration is tightened to clamp the inner fitting 110 to the guide channel.

Once the inner fitting 170 is attached to the guide track, the gaskets 205 are placed on the panel support surface 210 and the surface of outer fitting 175 that face the glass panel 145 and the outer fitting 175 is attached to the inner fitting 170 by fasteners 180. The stud(s) 185 may be received in a recess(es) 195 within the inner fitting 170 and project through an aperture(s) 200 in the outer fitting 175. The cap nuts 190 may then be coupled to the stud(s) 185 to assemble the fitting 110, which can then support the glass panel 145.

Figure 5:
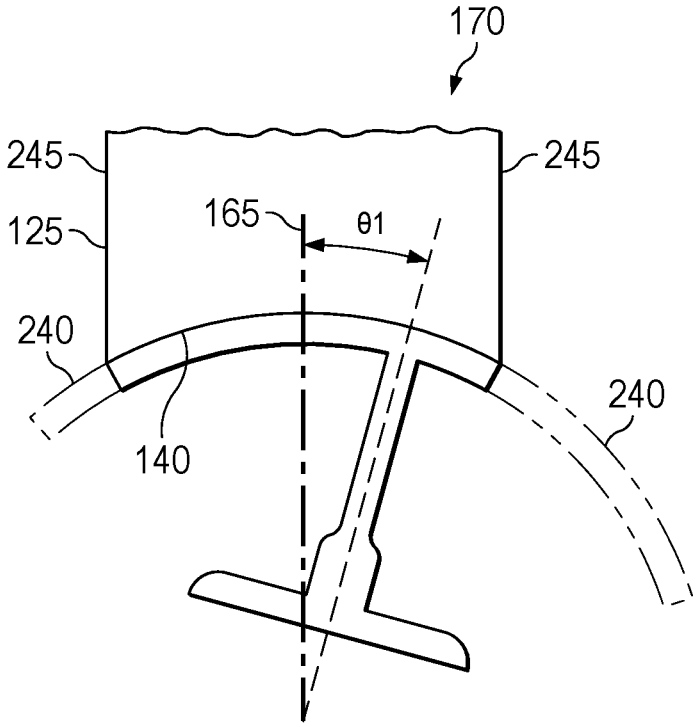
FIG. 5 representatively illustrates a plan view of an inner fitting with a portion removed for attachment to a mullion in accordance with an exemplary embodiment of the present technology.
Figure 6:
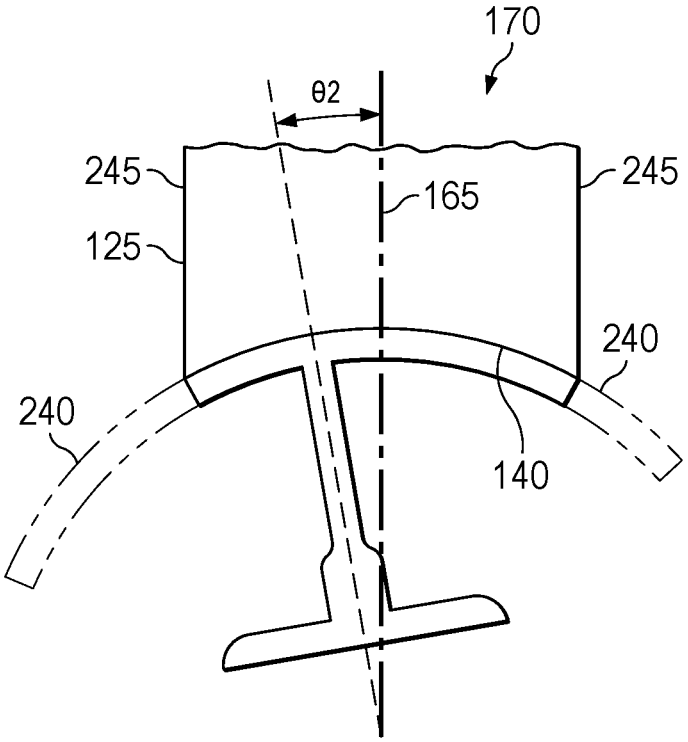
FIG. 6 representatively illustrates a plan view of an inner fitting with a portion removed for attachment to a mullion in accordance with an exemplary embodiment of the present technology.
Figure 16:
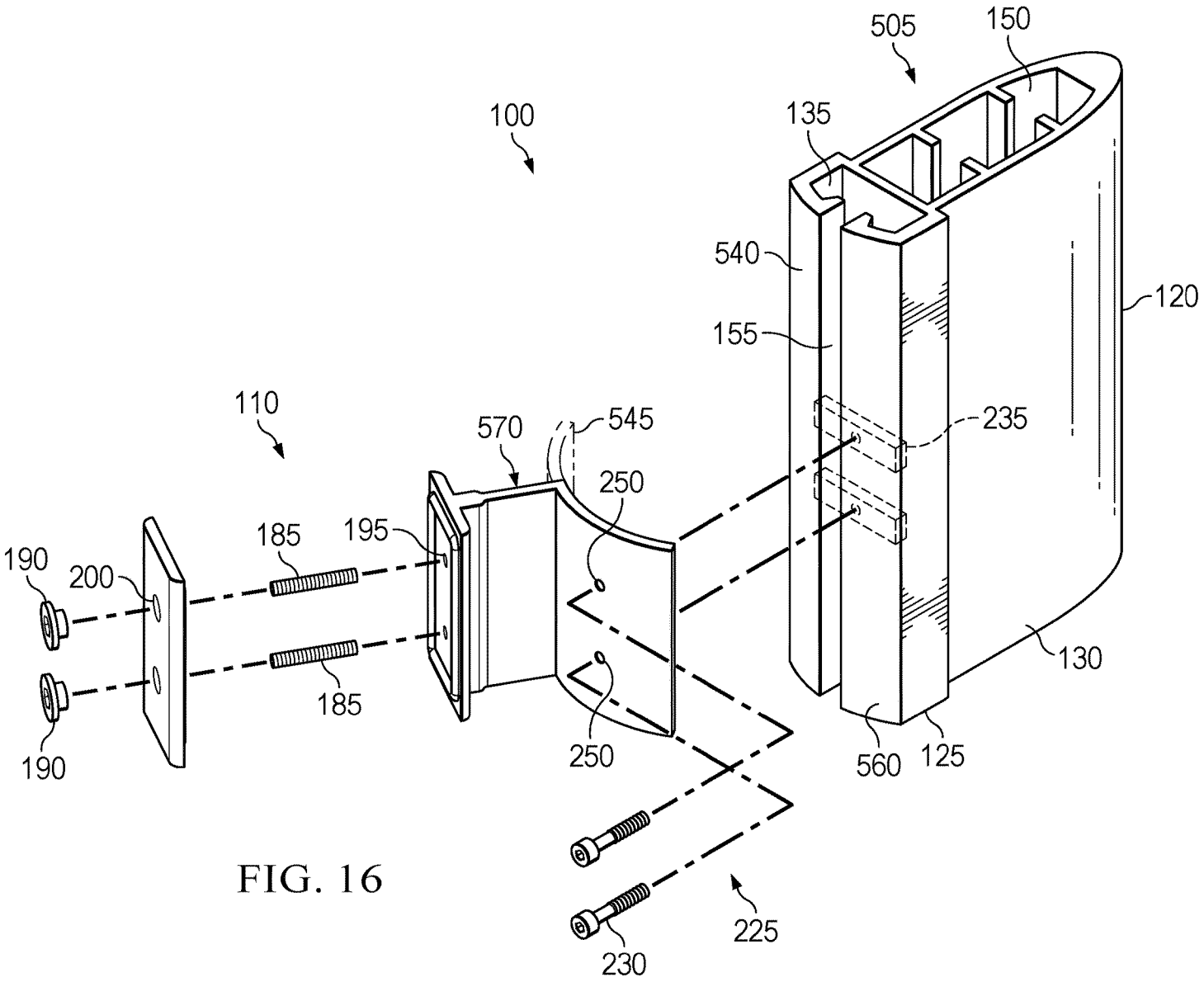
FIG. 16 representatively illustrates an additional embodiment of an isometric, exploded view of a construction assembly with a fitting and a mullion accordance with an exemplary embodiment of the present technology.
Figure 17:
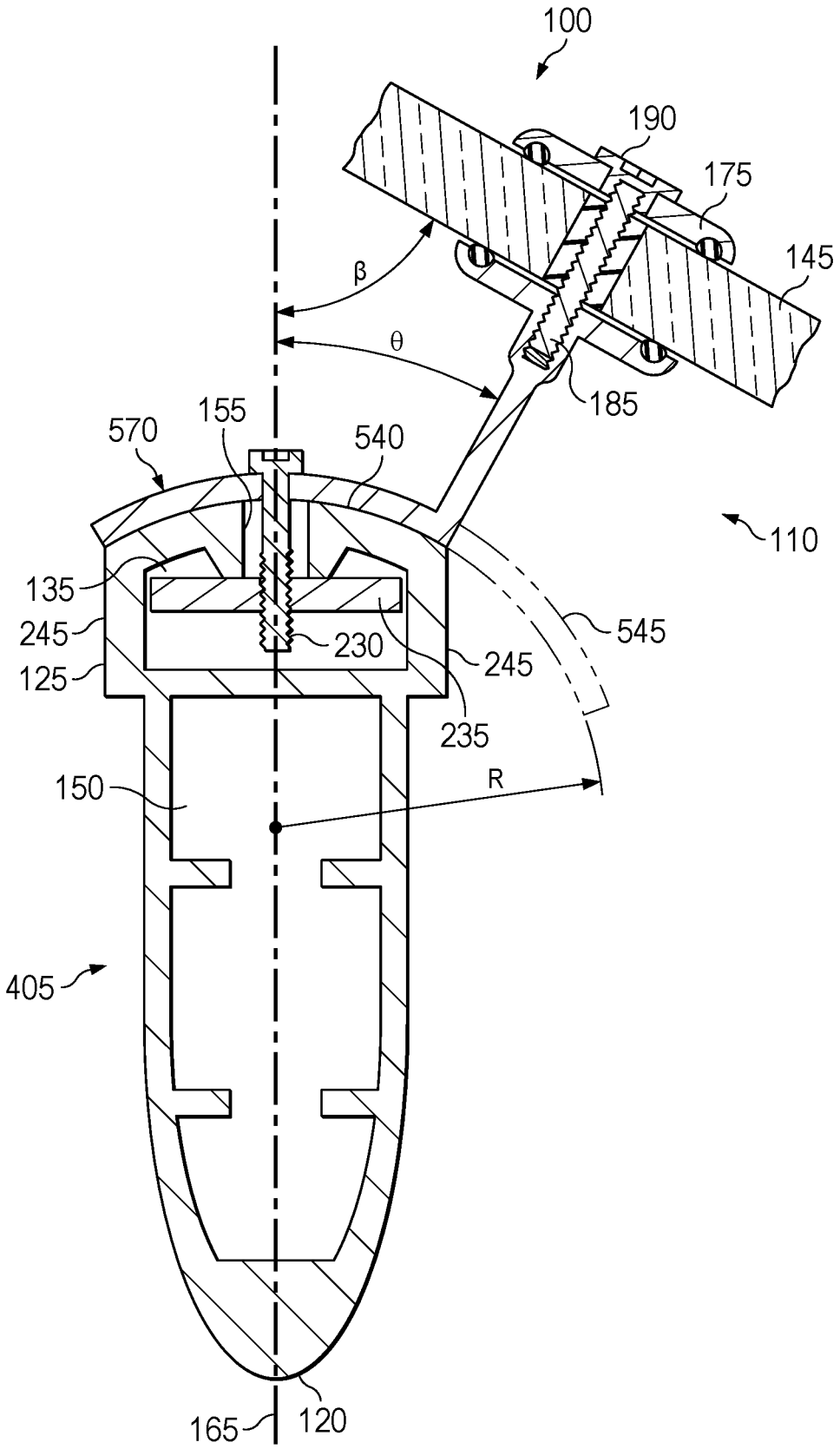
FIG. 17 representatively illustrates an additional embodiment of a top, cross-sectional view of a construction assembly with a fitting attached to a mullion and supporting a glass panel in accordance with an exemplary embodiment of the present technology.
Figure 18:
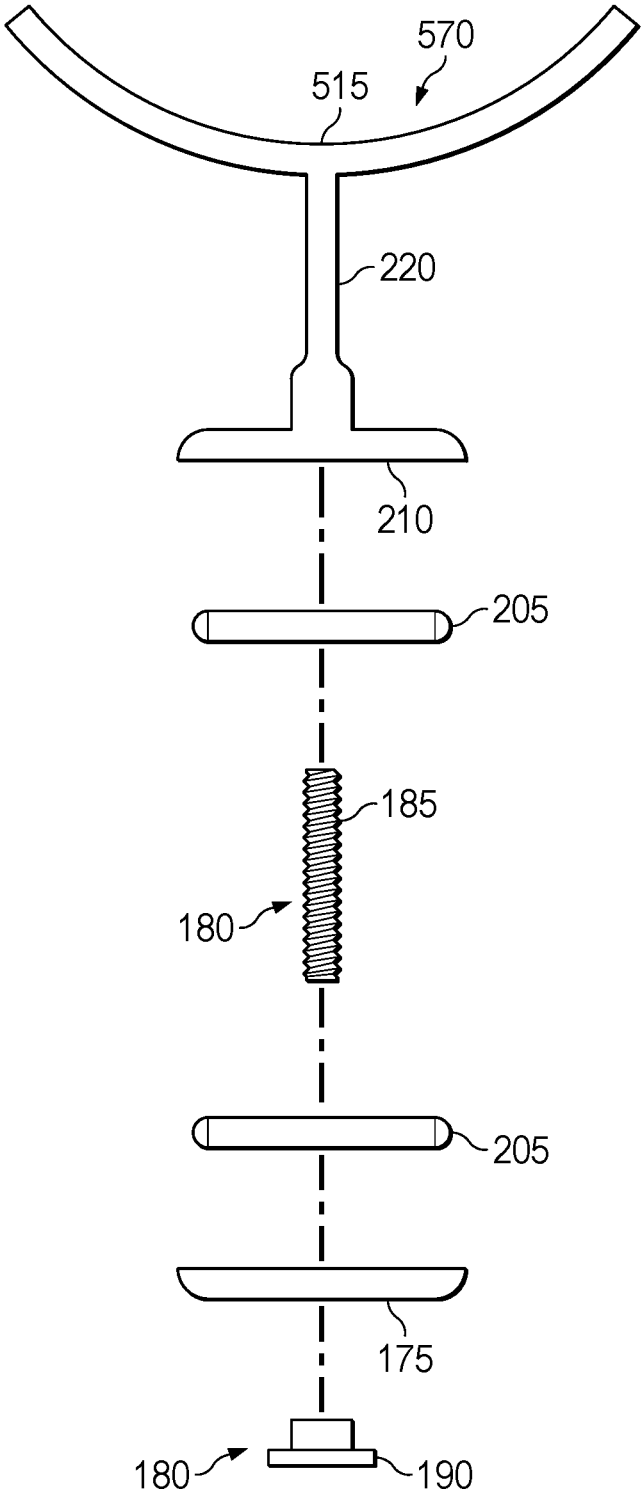
FIG. 18 representatively illustrates an additional embodiment of an exploded plan view of a fitting in accordance with an exemplary embodiment of the present technology.

FIGS. 5 and 6 illustrate some examples of angles θ1 and θ2 in which the radial surface 215 of the inner fitting 170 may be oriented to achieve different configurations of the inner fitting 170 with respect to the exterior face 140 of the second end of the mullion. Referring now to FIGS. 16-18 an additional embodiment of a mullion 505 and an inner fitting 570 are shown. The mullion 505 is similar to the mullion 105 with the following exception. The mullion 505 may comprise an exterior face 540 with a curved surface 560 configured to mate with the fitting 110. The curved surface 560 may comprise an outer surface that is convex with respect to the exterior surface of the construction section or glass panel 145 to which the curved surface 560 faces. The guide channel 155 may extend the length or a portion of the curved surface 560 of exterior face 540 of the mullion 105.

The inner fitting 570 is similar to the inner fitting 170 with the following exception. The inner fitting 570 may comprise an angular variation device for altering the angle of the glass panel 145 with respect to the orientation of the mullion 505. The inner fitting 570 may comprise a panel support surface 210, a radial surface 515, and an arm 220 located therebetween.

Referring to FIG. 17, the radial surface 515 of the inner fitting 570 may be attached to the curved surface 560 of the exterior face 540 of the mullion 105 by fasteners 225. The orientation of the radial surface 515 and the curved surface 560 allow the fitting 110 to engage with the mullion 105 and rotate along an angle β to accommodate various wall plane angles, which is the angle β between the mullion centerline 165 and the plane of the glass panel 145.

The radial surface 515 extends outwardly from the arm 220 to create an arc shape. The arc shape of the radial surface 515, when installed, abuts and runs parallel to the curved surface 560 of the exterior face 540. The arc shape of the radial surface 515 is convex with respect to the exterior surface of the construction section or glass panel 145 to which the curved surface 560 faces.

Referring to FIGS. 16 and 17, once designed, excess material 545 beyond the edge 245 of the mullion 505 is trimmed away or removed. For installation of the fitting 110 to the mullion 505, the inner fitting 570 is positioned on the exterior face 540 of the mullion 505 at desired angle beta, β. At least one hole 250 is drilled in the radial surface 515 of the inner fitting 570 such that the central lines of the at least one hole 250 aligns with the center line 165 of the guide channel 135. The inner fitting 570 is then attached to the guide track 135 of the mullion and held in-place by fasteners 225 comprising the at least one bolt 230 and nut 235 configuration. The bolts 230 are received within the guide track 155 and the nuts 235 are coupled thereto within the guide channel 135.

Figure 7:
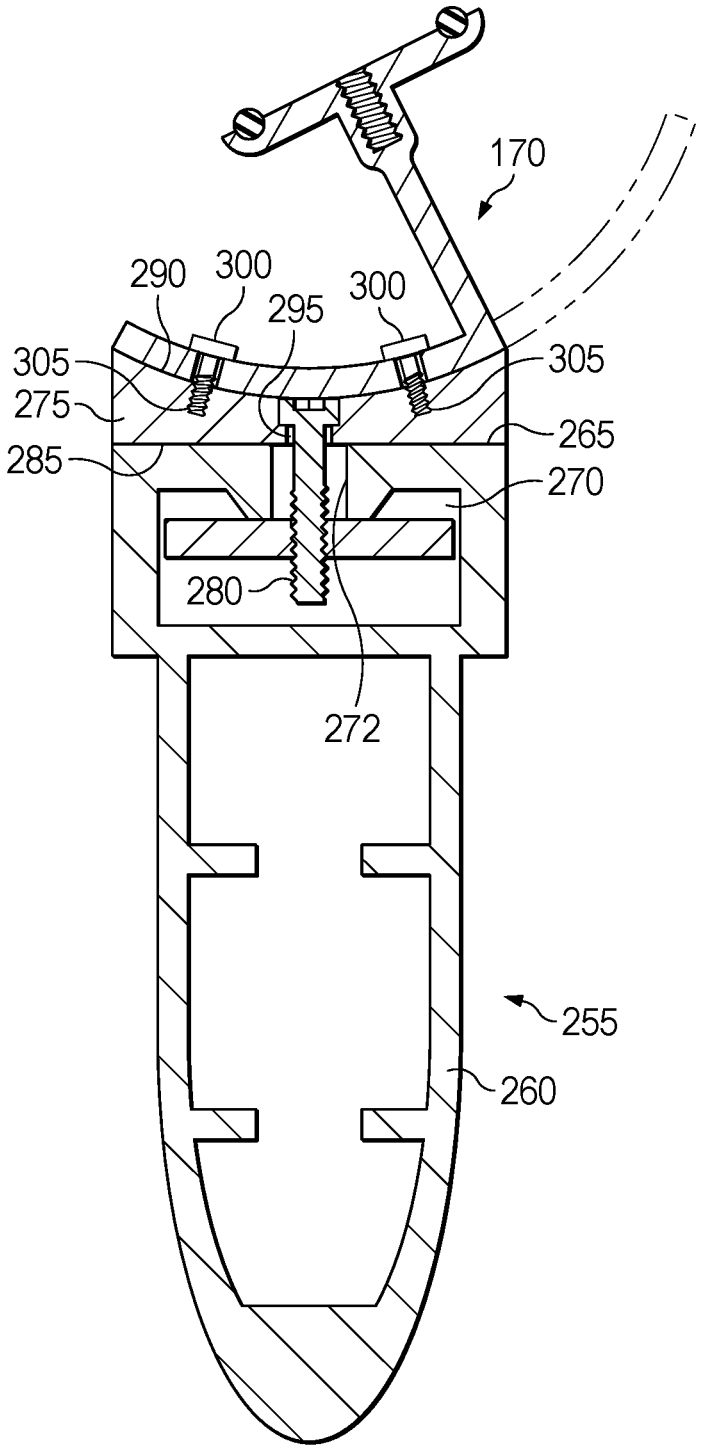
FIG. 7 representatively illustrates a top, cross-sectional view of an inner fitting attached to a conventional mullion by a spacer in accordance with an exemplary embodiment of the present technology.

Referring now to FIG. 7, an additional embodiment of a mullion 255 is shown. The mullion 255 resembles a standard mullion with a mullion body 260, an exterior face 265, a guide track 270, and a guide channel 272. The guide track 270 and guide channel 272 are similar to those discussed above. A mullion body is located between the first end and the second end of the mullion. The second end of the mullion may comprise the exterior face 265 that is generally perpendicular to the centerline of the mullion 255. A spacer 275 may be attached to the mullion 255 in a similar manner to the described above method utilizing a fastener 280 and the guide track 270 to couple the fitting 110 to the mullion 105. The spacer 275 may comprise a flat surface 285, a curved surface 290, and a centrally located aperture 295 that receives the fastener 280, which couples the spacer 275 to the guide track 270 of the mullion 255. The inner fitting 170 is then attached to the guide track 272 of the mullion 255 and held in-place by fasteners 280 comprising at least one bolt and nut configuration. The bolts are received within the guide track 270 and the nuts are coupled thereto within the guide channel 272. The flat surface 285 of the spacer 275 is coupled to the exterior face 265 of the mullion 255. The inner fitting 170 is then coupled to the spacer 275 by fasteners 300 that are received in threaded apertures 305 in the spacer 275. The inner fitting 170 may be attached to the spacer 275 at any angle consistent with the installation procedure described above. The curved surface 290 of the spacer 275, shown in FIG. 7 may comprise a concave shape.

Alternatively, the curved surface may also be convex, as shown by the curved surface 560 of the exterior face 540 in FIGS. 16-17 and would mate with the radial surface 515 of the inner fitting 570.

Figure 8:
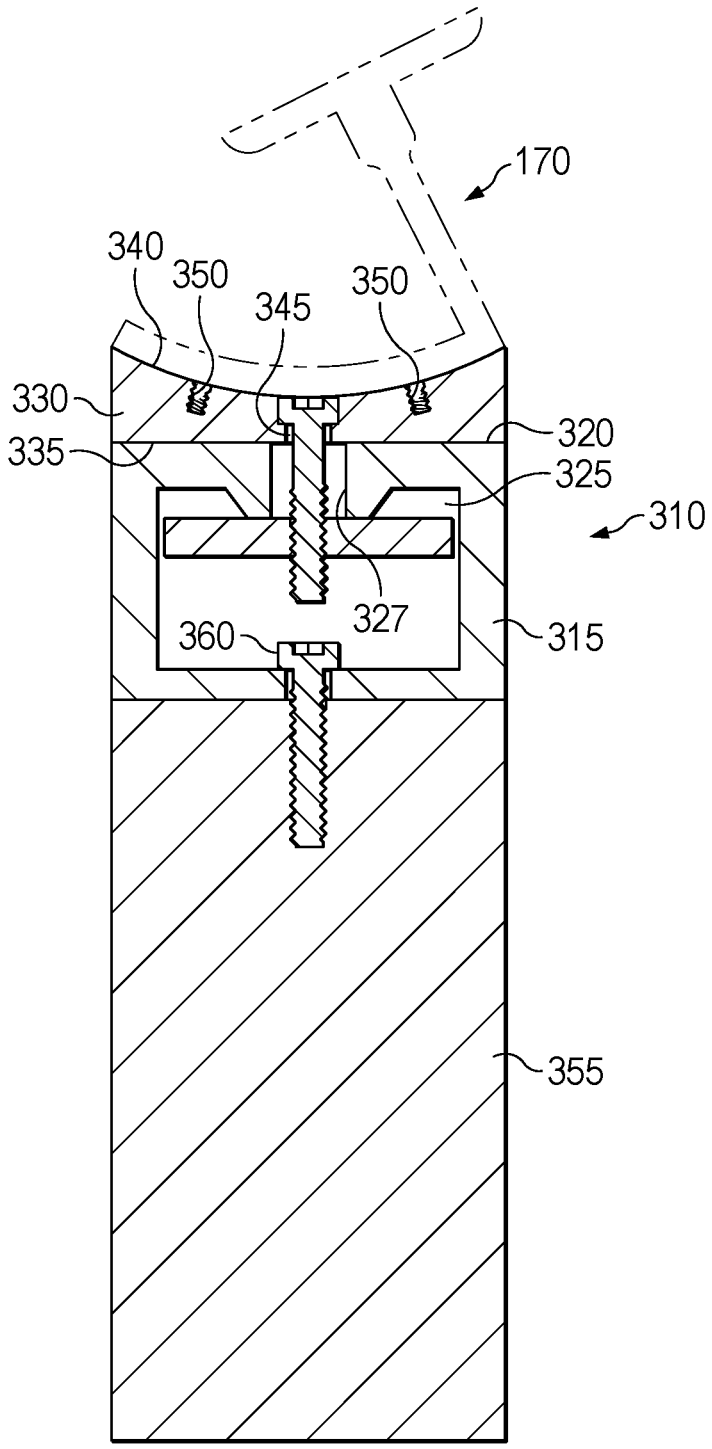
FIG. 8 representatively illustrates a top, cross-sectional view of an inner fitting attached to a mullion body by a spacer in accordance with an exemplary embodiment of the present technology.

Referring now to FIG. 8, an additional embodiment of a mullion 310 is shown. The mullion 310 may comprise a mullion body 315, an exterior face 320, a guide track 325, and a guide channel 327. The guide track 325 and guide channel 327 are similar to those discussed above. The mullion 310 may comprise a first end that may be positioned towards the interior of a structure being constructed and a second end. The mullion body 315 is located between the first end and the second end of the mullion. The second end of the mullion may comprise the exterior face 320, which is generally perpendicular to the centerline of the mullion 310. A spacer 330, similar to spacer 275 described above, may be attached to the mullion 310 in a similar manner to the described above. The spacer 330 may comprise a flat surface 335, a curved surface 340, and a centrally located aperture 345 that receives a fastener (comprising a nut and bolt configuration), which couples the spacer 330 to the guide track 325 of the mullion 310. The flat surface 335 of the spacer 330 is coupled to the exterior face 320 of the mullion 310. The inner fitting 170 is then coupled to the spacer 330 by at least one fastener (not shown) that are received in treaded apertures 350 in the spacer 330. The first end of the mullion 310 may be coupled to a block 355 by at least one fastener 360. The least one fastener 360 may couple to the block 355 by a threaded aperture or may be screwed or otherwise secured to the block 355. The block 355 may comprise any suitable material including but not limited to steel, aluminum, and non-metal materials such as wood.

The curved surface 340 of the spacer 330, shown in FIG. 8 may comprise a concave shape. Alternatively, the curved surface may also be convex, as shown by the curved surface 560 of the exterior face 540 in FIGS. 16-17 and would mate with the radial surface 515 of the inner fitting 570.

Figure 9:
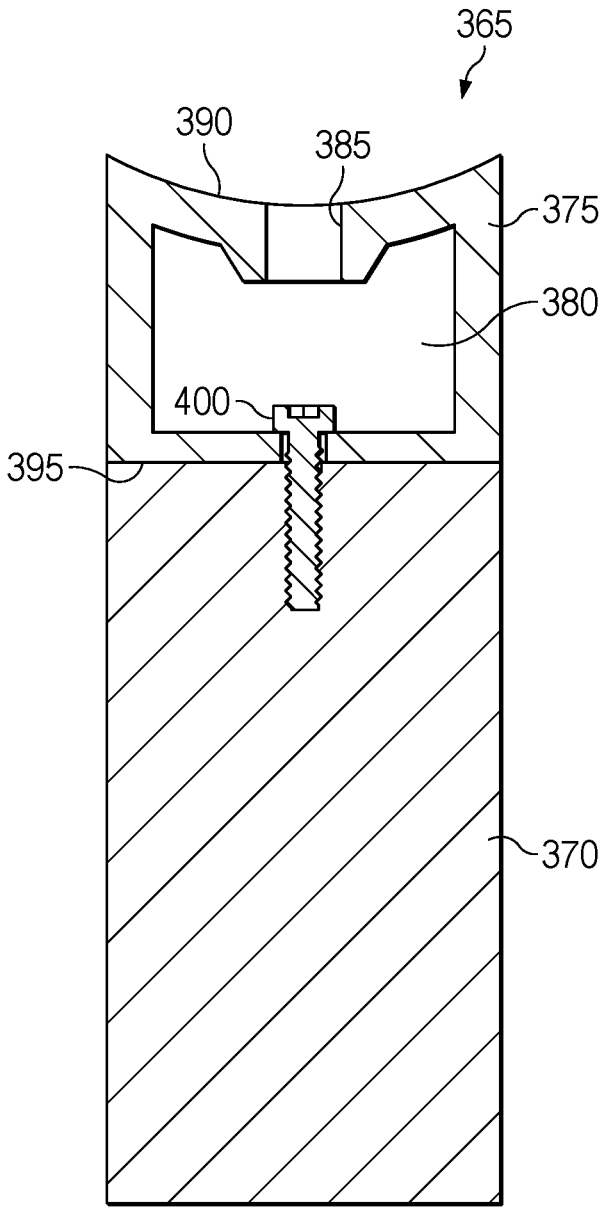
FIG. 9 representatively illustrates a top, cross-sectional view of a mullion in accordance with an exemplary embodiment of the present technology.

Referring now to FIG. 9, an additional embodiment of a mullion 365 is shown. The mullion 365 may comprise a block 370 and a guide element 375 coupled therewith. The guide element 375 may comprise a guide track 380 and guide channel 385 that operate with the fitting 110 to provide attachment and support for glass panels (not shown). The guide track 380 and guide channel 385 of this embodiment are similar to the those discussed above.

The guide element 375 may comprise an exterior face 390 and an interior face 395. The exterior face 390 of the guide element 375 of the mullion 365 may comprise a curved surface configured to mate with the fitting 110 (not shown). The curved surface 390 may comprise an outer surface that is concave with respect to the exterior surface of the construction section or glass panel 145 (not shown) to which the curved surface faces. Alternatively, the curved surface may also be convex, as shown by the curved surface 560 of the exterior face 540 in FIGS. 16-17 and would mate with the radial surface 515 of the inner fitting 570. The guide channel 385 may extend the length or a portion of the curved surface of exterior face 390 of the mullion 365. The interior face 395 of the guide element 375 may comprise a mounting surface configured to be attached to the block 370 by at least one fastener 400. The least one fastener 400 may couple to the block 370 by a threaded aperture or may be screwed or otherwise secured to the block 370.

Figure 10:
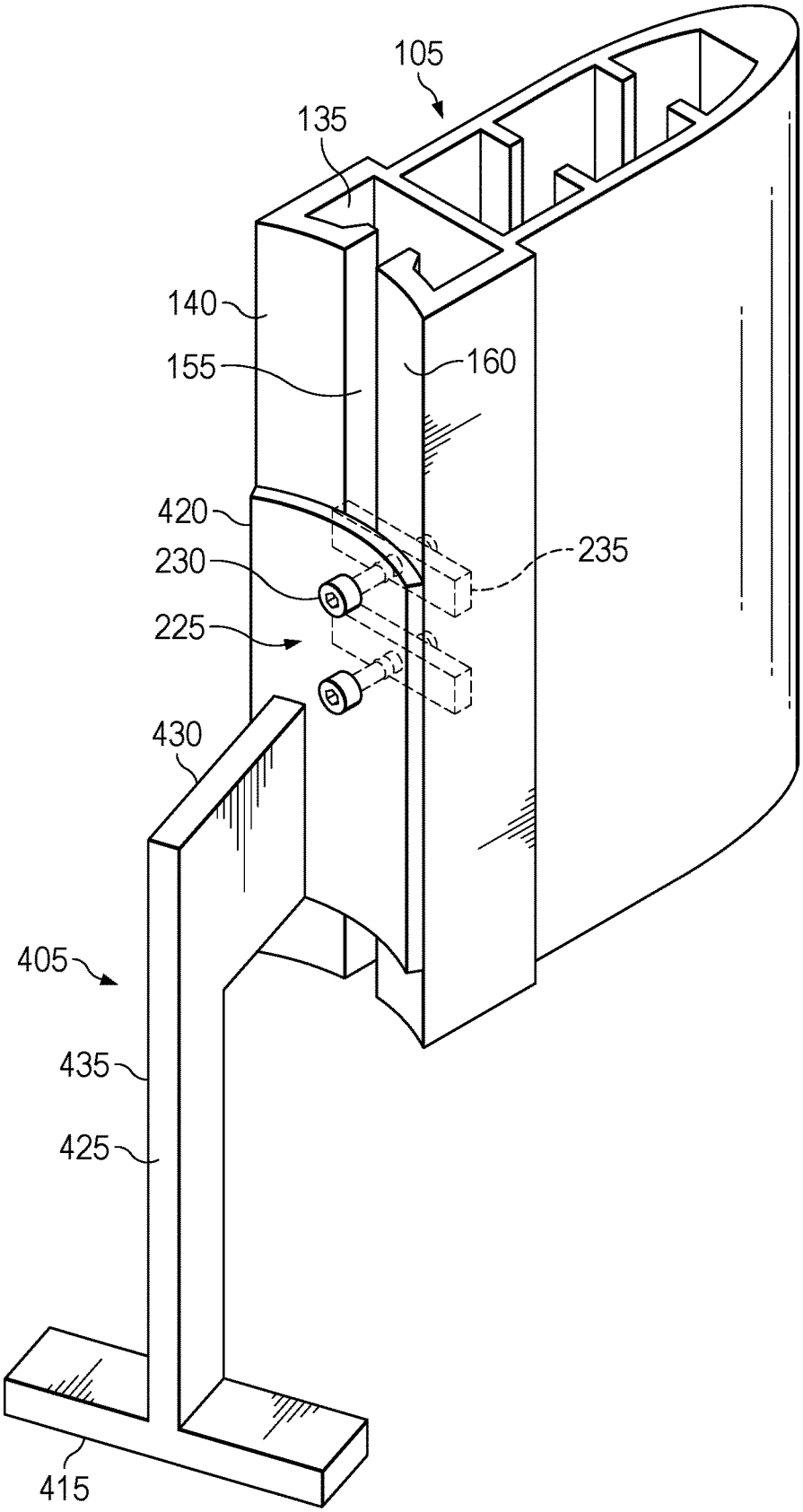
FIG. 10 representatively illustrates an isometric view of an angled hanger fitting attached to a mullion in accordance with an exemplary embodiment of the present technology.
Figure 11:
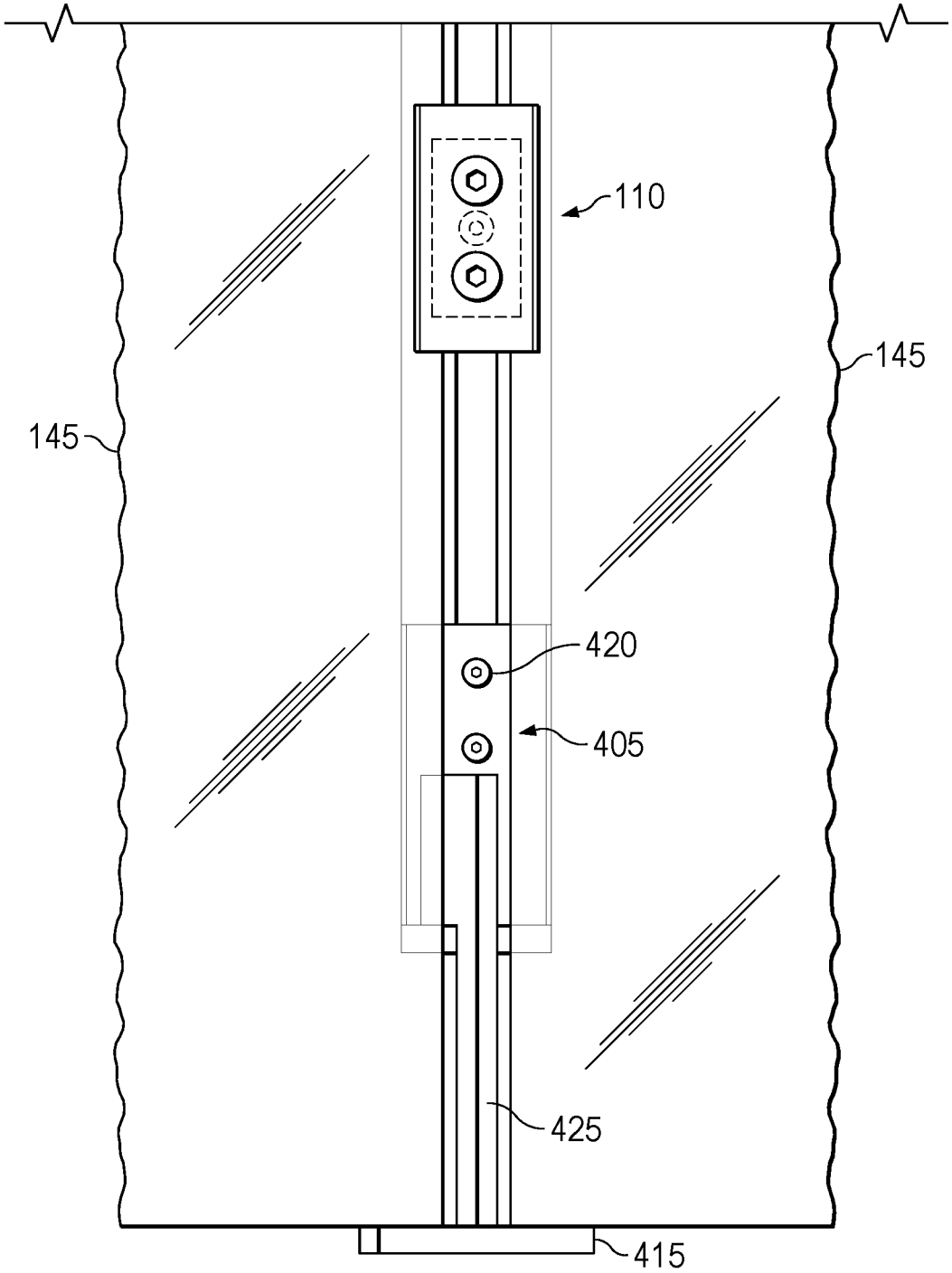
FIG. 11 representatively illustrates a front view of an angled hanger fitting and fitting attached to a mullion and supporting a glass panel in accordance with an exemplary embodiment of the present technology.
Figure 12:
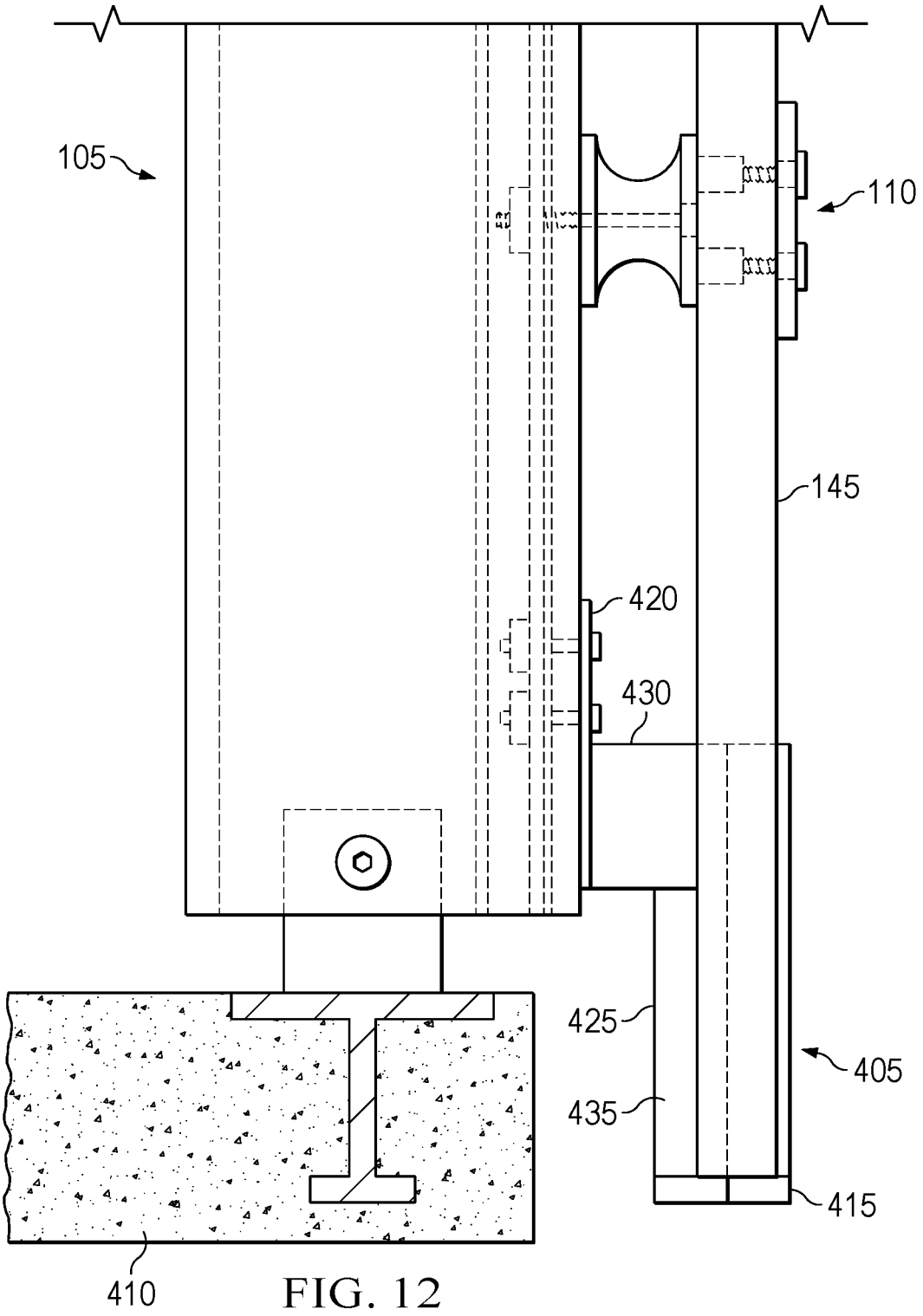
FIG. 12 representatively illustrates a cross-sectional, side view of and angled hanger fitting and fitting supporting a glass panel attached to a mullion with the mullion being attached to a floor in accordance with an exemplary embodiment of the present technology.

Referring now to FIG. 10, the construction system 100 may comprise an angled hanger fitting 405 to be used in conjunction with the fitting 110 described above to support a construction section in any manner. For example, the angled hanger fitting 405 may be provided for vertical support of a construction section and/or glass panel 145. As seen in FIGS. 11 and 12, the angled hanger fitting 405 may be utilized to support a construction section and/or glass panel 145 that is located below a floor, floor slab 410 or any other support section. In various embodiments, the angled hanger fitting 405 may be used in conjunction with the fitting 110 to support a construction section and/or glass panel 145. The shape of the angled hanger fitting 405 is similar to the fitting 110 above to allow the construction section and/or glass panel to be oriented at various angular positions.

The angled hanger fitting 405 may comprise an angular variation device for altering the angle of the glass panel 145 with respect to the orientation of the mullion 105. Standard fittings and mullions typically only allow the construction sections that are supported by the fitting to be oriented at a right angle or perpendicular to the mullion. The angular variation device allows the angle of the fitting 100 and angled hanger fitting 405 (construction sections/glass panels) with respect to the mullion 105 to be oriented at any angle selected during installation. The installation of the angled hanger fitting 405 is similar to the installation of the fitting 110 discussed above.

The angled hanger fitting 405 may comprise a panel support 415, a radial surface 420, and a support arm 425 located therebetween. The panel support 415 engages and supports the glass panel 145 and/or construction section. The support arm 425 comprises a first portion 430 that extends outwardly from the radial surface 420 and a second portion 435 that extends downwardly to the panel support 415. In one embodiment the support arm 425 is generally L-shaped. The panel support 415 is located generally horizontal and perpendicular to the second portion 435 of the support arm 425. The support arm 425 extends between the panel support 415 and the radial surface 420. The support arm 425 may be oriented generally perpendicular to the radial surface 420, which connects to the mullion 105.

The radial surface 420 of the angled hanger fitting 405 may be attached to the curved surface 160 of the exterior face 140 of the mullion 105 by at least one fastener 225. The radial surface 420 may comprise a convex shape that aligns with and abuts the concave curved surface 160. As such, curved surface 160 is concave with reference to the panel 145 and radial surface 420 is convex with reference to the curved surface 160 The fasteners 225 may comprise at least one bolt 230 and nut 235 configuration. Once the angled hanger fitting 405 is attached to the mullion 105, the angled hanger fitting 405 may still be moved with respect to the mullion 105. The bolts 230 are received within the guide channel 135 and the nuts 235 are coupled thereto within the guide track 155. The angled hanger fitting 405 is still movable with respect to the mullion 105 until the fasteners 225 are secured.

Similar to the fitting 110 described above, the orientation of the radial surface 420 and the curved surface 160 allow the angled hanger fitting 405 to engage with the mullion 105 and rotate along an angle to accommodate various wall plane angles, which is the angle between the mullion centerline and the plane of the glass panel 145.

The radial surface 420 extends outwardly from the support arm 425 to create an arc shape. The arc shape of the radial surface 420, when installed, abuts and runs parallel to the curved surface 160 of the exterior face 140.

Figure 19:
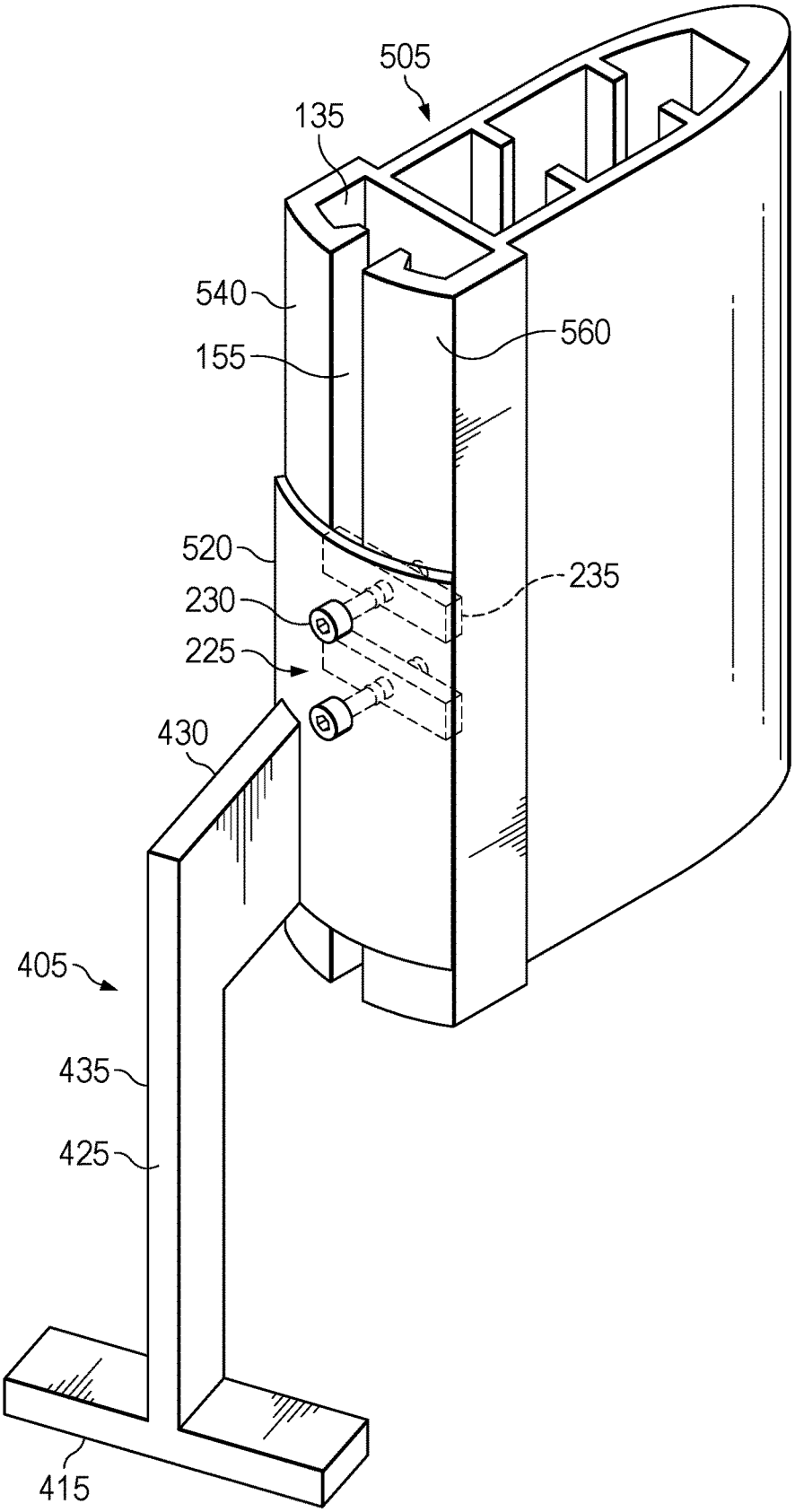
FIG. 19 representatively illustrates an additional embodiment of an isometric view of an angled hanger fitting attached to a mullion in accordance with an exemplary embodiment of the present technology.

Referring now to FIG. 19, an additional embodiment of the angled inner fitting 510 is shown. The angled hanger fitting 510 is similar to the angled hanger fitting 405 with the following exception. The angled hanger fitting 510 may comprise a panel support 415, a radial surface 520, and a support arm 425 located therebetween. The radial surface 520 of the angled hanger fitting 510 may be attached to the curved surface 560 of the exterior face 540 of the mullion 105 by fasteners 225. The orientation of the radial surface 515 and the curved surface 560 allow the fitting 110 to engage with the mullion 505 and rotate along an angle β to accommodate various wall plane angles, which is the angle β between the mullion centerline 165 and the plane of the glass panel 145. The arc shape of the radial surface 515 is concave with respect to the exterior surface of the construction section or glass panel 145 to which the curved surface 560 faces.

Referring to FIGS. 11 and 12, the fitting 110 and the angled hanger fitting 405 may be used to support a construction section and/or glass panel 145. The angled hanger fitting 405 allows the construction section and/or glass panel 145 to extend below the floor 410 or any other construction support (slab), which solves the problem of being able to extend the panel 145 past a slab even thought the slab may interrupt the mullion from being continuous. The installation of the angled hanger fitting 405 is the same as the installation of the other fitting described in detail above. The fitting 110 and the angled hanger fitting 405 shown in FIGS. 16-19 may also be used in the same manner as discussed above.

Figure 13:
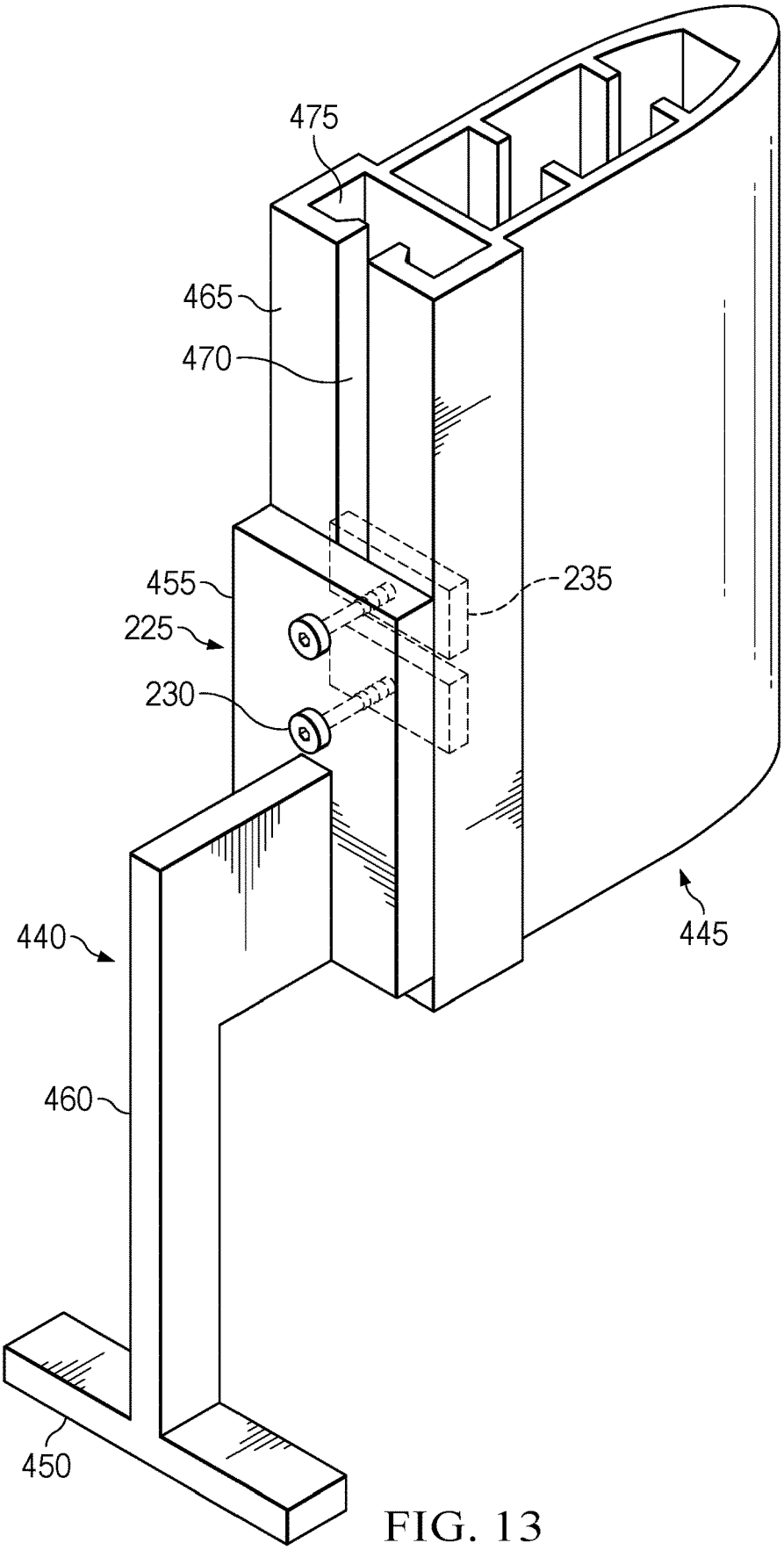
FIG. 13 representatively illustrates an isometric view of a hanger fitting attached to a mullion in accordance with an exemplary embodiment of the present technology.
Figure 14:
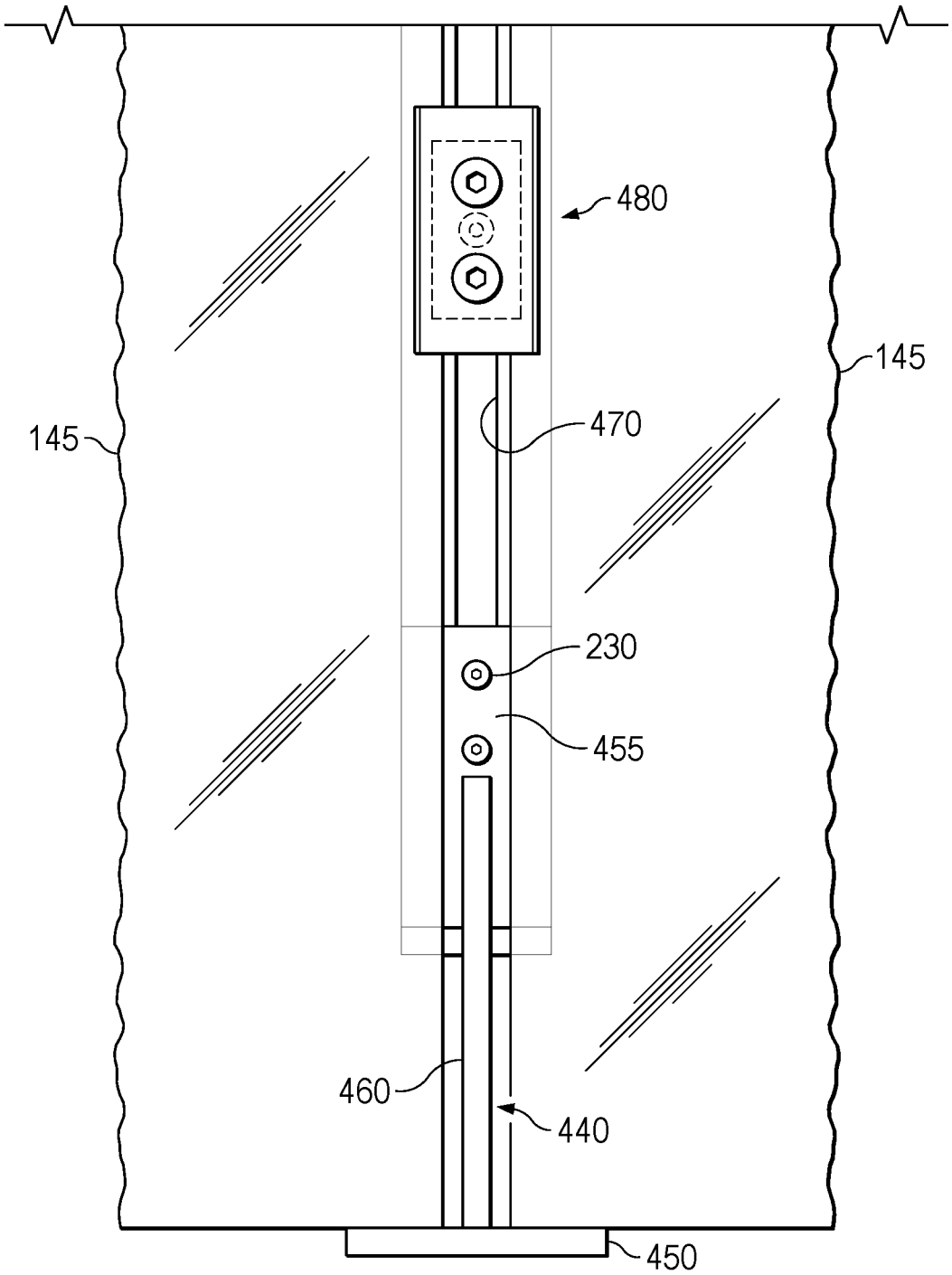
FIG. 14 representatively illustrates a front view of a hanger fitting and fitting attached to a mullion and supporting a glass panel in accordance with an exemplary embodiment of the present technology.
Figure 15:
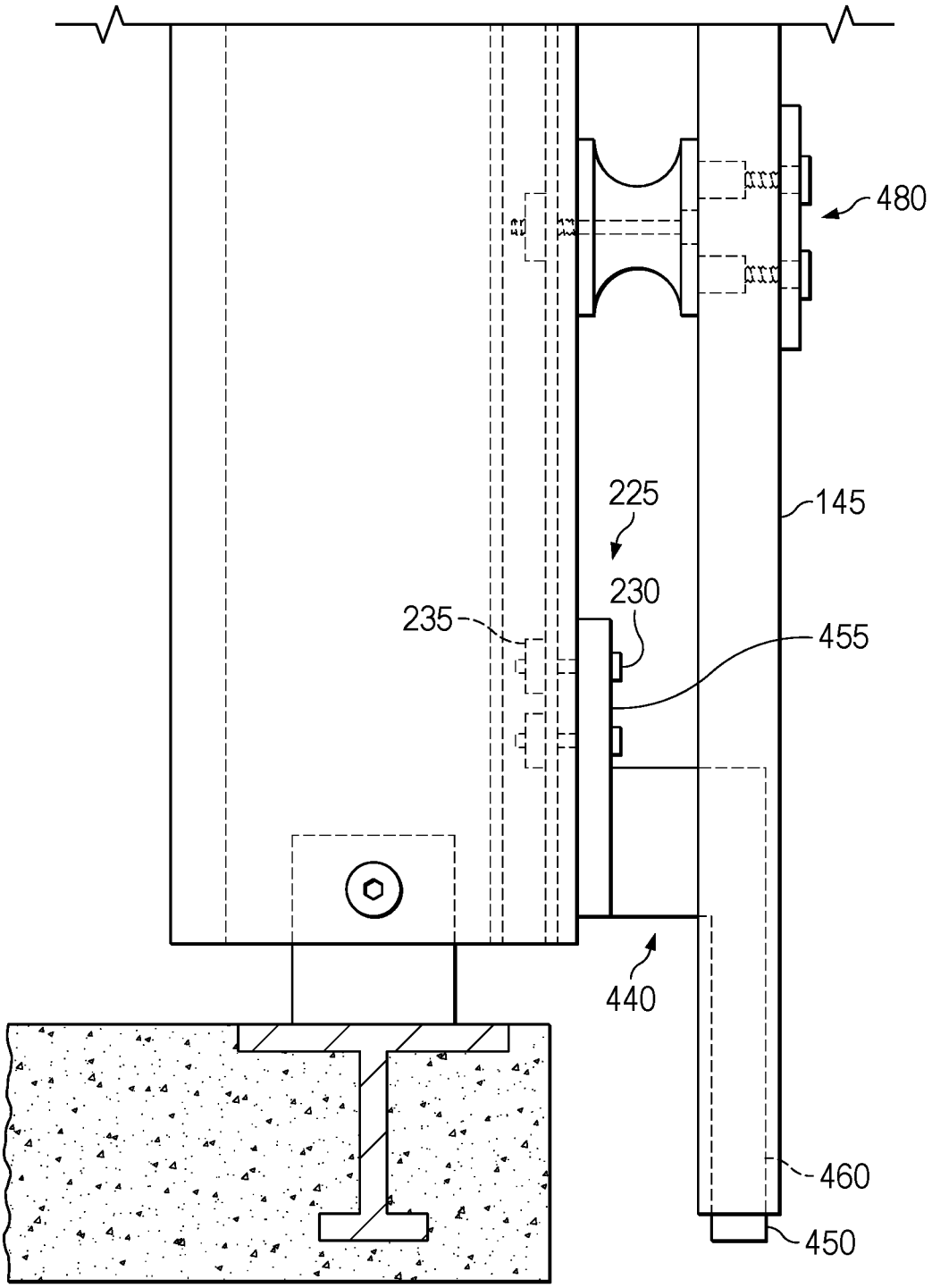
FIG. 15 representatively illustrates a cross-sectional, side view of a hanger fitting and fitting supporting a glass panel attached to a mullion with the mullion being attached to a floor in accordance with an exemplary embodiment of the present technology.

Referring now to FIGS. 13-15 a hanger fitting 440 is shown couple to a conventional mullion 445. SEE FIG. 7. The hanger fitting 440 is similar to the embodiment disclosed in FIGS. 10-12 with the exception of the radial surface. The hanger fitting 440 may comprise a panel support 450, an attachment surface 455, and a support arm 460 located therebetween. The panel support 450 engages with the glass panel 145 and/or construction section. The support arm 460 comprises a first portion that extends outwardly from the attachment surface 455 and a second portion that extends downwardly to the panel support 450. In one embodiment the support arm 460 is generally L-shaped. The panel support 450 is located generally horizontal and perpendicular to the second portion of the support arm 460. The support arm 460 extends between the panel support 450 and the attachment surface 455. The support arm 460 may be oriented generally perpendicular to the attachment surface 455, which connects to the mullion 445.

The attachment surface 455 of the hanger fitting 440 may be attached to an exterior face 465 of the mullion 445 by at least one fastener 225. The fasteners 225 may comprise at least one bolt 230 and nut 235 configuration. Once the hanger fitting 440 is attached to the mullion 445, the hanger fitting 440 may still be moved with respect to the mullion 445. The bolts 230 are received within a guide channel 470 and the nuts 235 are coupled thereto within a guide track 475. The hanger fitting 440 is still movable with respect to the mullion 445 until the fasteners 225 are secured.

Referring to FIGS. 14 and 15, the fitting 480 and the hanger fitting 440 may be used to support a construction section and/or glass panel. The hanger fitting 440 allows the construction section and/or glass panel 140 to extend below the floor 410 or any other construction support.

In a construction system according to various aspects of the present technology, mullions may be attached to the structure of a building to provide a framework for supporting construction sections. Suitably configured fittings may be attached to the mullions to provide point-supported or continuously supported retention of construction sections. Construction systems in accordance with various exemplary embodiments of the present technology may be used to build any type of structure, such as a point-supported glass wall, for example. The construction system may also be used to achieve various aesthetic benefits. For example, the panes of glass used to form a glass wall will generally be displaced away from the mullions, making it more difficult to see the mullions from an exteriorly disposed vantage point. Additionally, construction systems in accordance with the present technology may be used to achieve any structural benefit, whether now known or hereafter described in the art, such as the ability to construct a multi-story point-supported glass wall system using substantially vertically-aligned mullions without the need for horizontally-aligned mullions.

Constructs (i.e., construction designs) that may be realized via implementation of various embodiments of the present technology shall be understood to comprise anything that may be at least partially assembled from at least one or more component parts, such as, for example: a window; a wall; a partition; a frame; a panel; a covering; a dome; a door; a display case; a display wall; a display frame; a cubicle; a presentation display; a booth; an enclosure; a temporary habitat; a mobile home; a video device array; various architectural construction elements; and/or the like.

A 'construction section' shall be understood to comprise any component part of a construct surface, such as, for example, a pane of glass, a panel of wood, a sheet of drywall, a graphite board, Plexiglas, Lucite, a video device element, etc. Furthermore, a construction section may comprise any two-dimensional (e.g., substantially planar) or three-dimensional (e.g., polyhedral, spherical, hemispherical, elliptical, parabolic, etc.) geometry and/or any combination thereof.

In the foregoing description, the technology has been described with reference to specific exemplary embodiments. Various modifications and changes may be made, however, without departing from the scope of the present technology as set forth. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any appropriate order and are not limited to the explicit order presented in the specific examples. Additionally, the components and/or elements recited in any system embodiment may be combined in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

As used herein, the terms "comprises," "comprising," or any variation thereof, are intended to reference a non-exclusive inclusion, such that a process, method, article, composition or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same. Any terms of degree such as "substantially," "about," and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

The present technology has been described above with reference to an exemplary embodiment. However, changes and modifications may be made to the exemplary embodiment without departing from the scope of the present technology. These and other changes or modifications are intended to be included within the scope of the present technology.

The invention claimed is:

1. A construction system for a glass panel, comprising:
- a mullion comprising:
  - at least one guide track disposed at least partially along at least one dimension of the mullion;
  - a curved exterior face; and
  - a guide channel extending along a length of the curved exterior face; and
- a panel fitting configured to be slidably coupled to the curved exterior face, comprising:
  - an inner fitting comprising an angular variation device configured to alter an angle of the glass panel, a panel support surface, and an arm extending between the angular variation device and the panel support surface;
  - an outer fitting;
  - a first fastener coupling the inner fitting to the mullion, the first fastener comprising:
    - an interior piece positioned inside the guide track;
    - an exterior piece positioned outside of the guide track; and
  - a second fastener coupling the outer fitting to the inner fitting;
- wherein the panel fitting is selectively adjustable along the guide track while engaged to the guide track and a portion of the glass panel is received between the inner fitting and the outer fitting.

2. The construction system of claim 1, further comprising a gasket located between the panel support surface of the inner fitting and the glass panel and the outer fitting and the glass panel.

3. The construction system of claim 1, wherein the angular variation device is a first angular variation device and further comprising an angled hanger fitting configured to be slidably coupled to the curved exterior face of the mullion, comprising:
- a second angular variation device;
- a second panel support surface;
- a support arm connecting the second angular variation device and the second panel support surface; and
- a fastener coupling the angled hanger fitting to the mullion, comprising:
  - a second interior piece positioned inside the guide track;
  - a second exterior piece positioned outside of the guide track;
- wherein the angled hanger fitting is selectively adjustable along the guide track while engaged to the guide track and a second portion of the glass panel is supported by the second panel support surface.

4. The construction system of claim 3, wherein the second angular variation device comprises a radial surface configured to alter the angle of the glass panel with respect to a centerline of the mullion.

5. The construction system of claim 1, wherein the angular variation device comprises a radial surface configured to alter the angle of the glass panel with respect to a centerline of the mullion.

6. The construction system of claim 5, wherein the radial surface is convex with respect to an exterior surface of the glass panel.

7. The construction system of claim 6, wherein the radial surface is oriented parallel to the curved exterior face of the mullion when the inner fitting is coupled to the curved exterior surface of the mullion.

8. The construction system of claim 6, wherein the radial surface is concave with respect to an exterior surface of the glass panel.

9. The construction system of claim 8, wherein the radial surface is oriented parallel to the curved exterior face of the mullion when the inner fitting is coupled to the curved exterior surface of the mullion.

10. A construction system, comprising:
- a glass panel;
- a mullion comprising:
  - at least one guide track disposed at least partially along at least one dimension of the mullion;
  - a curved exterior face; and
  - a guide channel extending along a length of the curved exterior face; and
- a panel fitting configured to be slidably coupled to the curved exterior face, comprising:
  - an inner fitting comprising an angular variation device configured to alter an angle of the glass panel, a panel support surface, and an arm extending between the angular variation device and the panel support surface;
  - an outer fitting;
  - a first fastener coupling the inner fitting to the mullion, the first fastener comprising:
    - an interior piece positioned inside the guide track;
    - an exterior piece positioned outside of the guide track; and
  - a second fastener coupling the outer fitting to the inner fitting;
- wherein the panel fitting is selectively adjustable along the guide track while engaged to the guide track and a portion of the glass panel is received between the inner fitting and the outer fitting.

11. The construction system of claim 10, further comprising a gasket located between the panel support surface of the inner fitting and the glass panel and the outer fitting and the glass panel.

12. The construction system of claim 10, wherein the angular variation device is a first angular variation device and further comprising an angled hanger fitting configured to be slidably coupled to the curved exterior face of the mullion, comprising:
- a second angular variation device;
- a second panel support surface;
- a support arm connecting the second angular variation device and the second panel support surface; and a fastener coupling the angled hanger fitting to the mullion, comprising:

a second interior piece positioned inside the guide track;

a second exterior piece positioned outside of the guide track;

wherein the angled hanger fitting is selectively adjustable along the guide track while engaged to the guide track and a second portion of the glass panel is supported by the second panel support surface.

13. The construction system of claim 12, wherein the second angular variation device comprises a radial surface configured to alter the angle of the glass panel with respect to a centerline of the mullion.

14. The construction system of claim 10, wherein the angular variation device comprises a radial surface configured to alter the angle of the glass panel with respect to a centerline of the mullion.

15. The construction system of claim 14, wherein the radial surface is convex with respect to an exterior surface of the glass panel.

16. The construction system of claim 15, wherein the radial surface is oriented parallel to the curved exterior face of the mullion when the inner fitting is coupled to the curved exterior surface of the mullion.

17. The construction system of claim 15, wherein the radial surface is concave with respect to an exterior surface of the glass panel.

18. The construction system of claim 17, wherein the radial surface is oriented parallel to the curved exterior face of the mullion when the inner fitting is coupled to the curved exterior surface of the mullion.

* * * * *